US005954220A

United States Patent [19]

Herbert

[11] Patent Number: 5,954,220

[45] Date of Patent: Sep. 21, 1999

[54] DANGEROUS GOODS CLOSURE SYSTEM

[76] Inventor: John Herbert, 5 Robina Street, St Ives, Australia, NSW 2075

[21] Appl. No.: 08/952,128

[22] PCT Filed: May 31, 1996

[86] PCT No.: PCT/AU96/00331

§ 371 Date: Nov. 5, 1997

§ 102(e) Date: Nov. 5, 1997

[87] PCT Pub. No.: WO96/40569

PCT Pub. Date: Dec. 19, 1996

[30] Foreign Application Priority Data

Jun. 7, 1995 [AU] Australia ..... PN3405

[51] Int. Cl.[6] ..... B65D 17/40

[52] U.S. Cl. ..... 220/276; 215/253

[58] Field of Search ..... 220/270, 276; 215/253, 256

[56] References Cited

U.S. PATENT DOCUMENTS 3,831,798 8/1974 Rowe et al. ..... 220/276 X 5,511,679 4/1996 Beck ..... 220/270

*Primary Examiner*—Stephen K. Cronin

*Attorney, Agent, or Firm*—James A. Quinton

[57] ABSTRACT

A closure system for open headed containers utilizing a thermoplastic closure of the type having a disk and skirt depending therefrom the skirt portion including an annular ring adjacent its lower extremity adapted to lie beneath and radially inwardly with respect to an outwardly directed annular protrusion on a complementary container; a weakened stress relieving annular portion on the skirt lying immediately above said annular ring; the annular weakened portion having a wall thickness sized to ensure that stress relief and attendant creep in the thermoplastic material of the closure after affixation of the closure to the container occurs substantially at the annular weakened portion thereby allowing the lower portions of the annular ring to move radially inwardly; the wall thickness of the annular weakened portion at all times being of adequate thickness to resist premature rupture in the event that the closure/container unit is subjected to an impact; seal means between the closure and the container above the annular ring.

11 Claims, 2 Drawing Sheets

DANGEROUS GOODS CLOSURE SYSTEM

Figure 1:
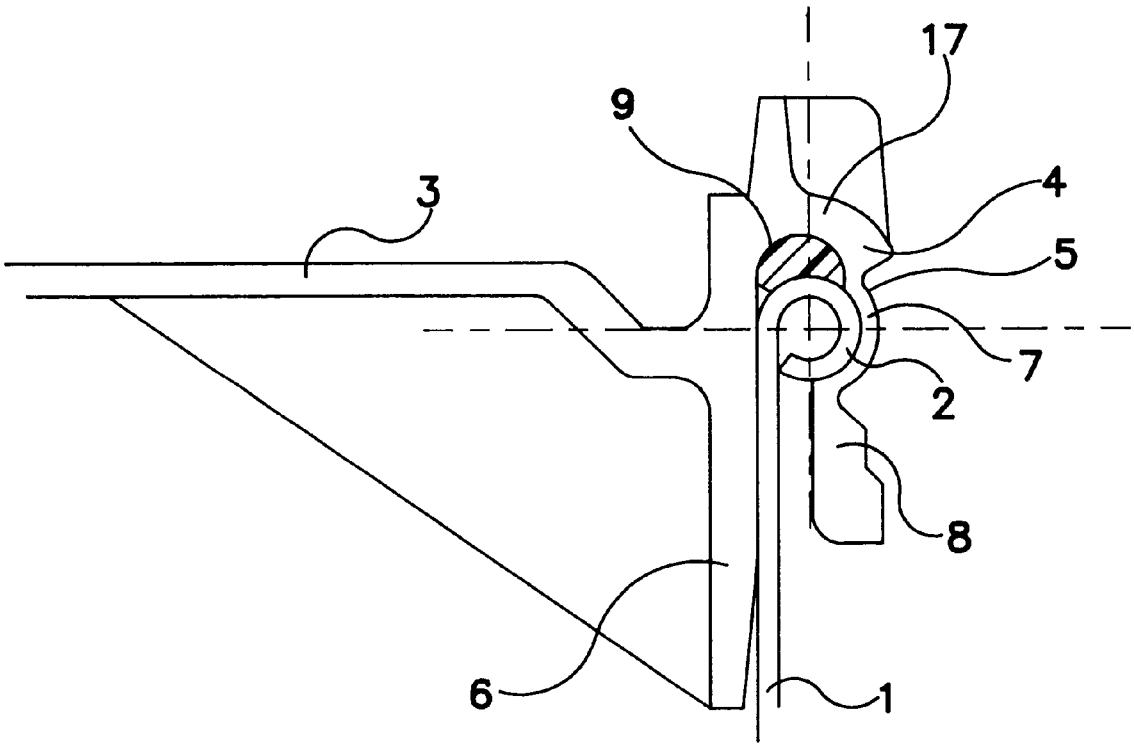
Figure 2:
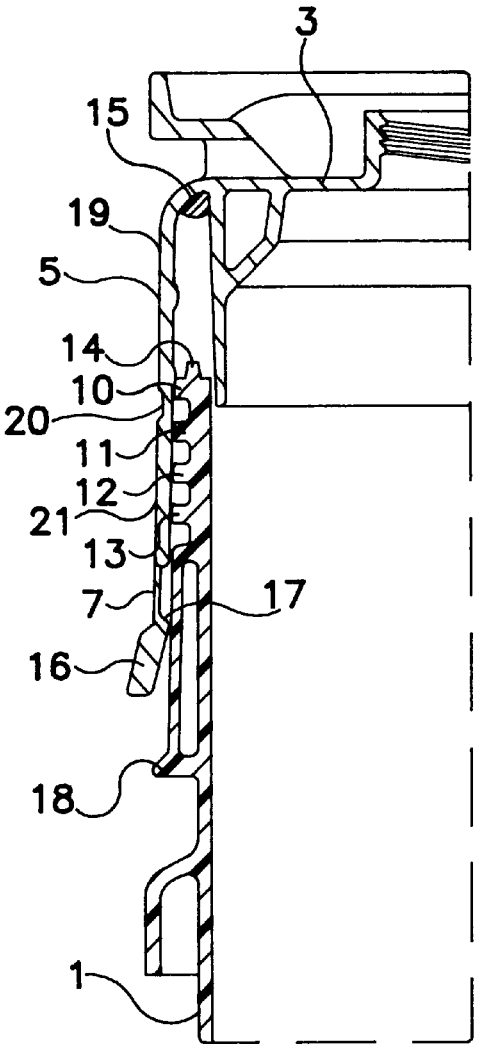
Figure 3:
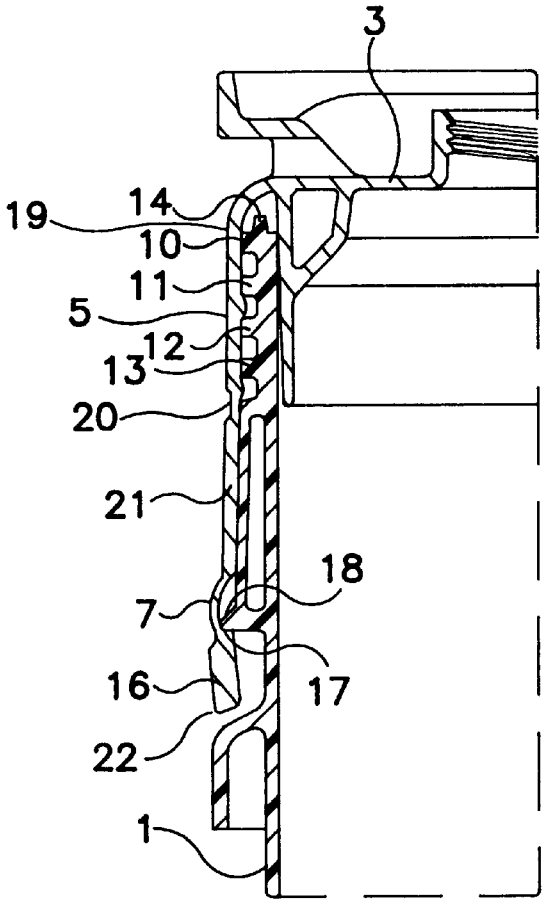

The present invention relates to a closure retention system for containers and has particular application to dangerous goods containers having snap-on, as distinct from screw threaded, closures. For many years dangerous goods have been supplied in open head metal buckets with metal lids; a seal being effected adjacent the upper extremity of the bucket where it lies against the lid.

International regulations concerning dangerous goods containers have now been devised whereby such containers must withstand certain defined tests such as drop, stack and pressure tests without rupture of a seal.

Various thermoplastic container/closure combinations have been devised usually with single retainers although such containers have consistently failed to pass the stringent United Nations (UN) Dangerous Goods Code. The principal difficulty associated with thermoplastic closures of the type which utilise a ring incorporated in the closure skirt to override and then underlie an outwardly directed protuberance on the pail is that once the ring has passed over the protuberance on the pail and lies in its closed position beneath such protuberance it is still subject to stress which eventually causes the thermoplastic material from which the ring is fabricated to creep radially outward hence degrading the seal between such ring and the outwardly directed protrusion on the container. Elaborate systems for such "snap-on" thermoplastic closures have been devised involving multiple retainers co-operating with multiple protrusions on containers but to date most such closures still fail to pass the UN Group 2 Liquid Dangerous Goods Code.

It is accordingly an object of the present invention to provide a thermoplastic closure for a dangerous goods or high performance bucket; the seal of such closure adapted to withstand substantial impacts which may be inflicted on the container/closure unit.

According to the present invention there is provided a thermoplastic closure for an open headed container adapted to effect an impact resistant seal with such a container; the closure being comprised of a circular disk portion and a peripheral skirt portion; the skirt portion including a thickened portion adapted to lie beneath and radially inward with respect to an outwardly directed annular protrusion on a complimentary container; a weakened stress relieving annular portion on the skirt lying immediately above said annular thickened portion; the annular weakened portion having a wall thickness at least twenty percent less than that of the annular thickened portion of the skirt although of adequate thickness to resist premature rupture in the event that the closure/container unit is subject to an impact; seal means between the closure and the container above the annular thickened portion.

Three embodiments of the present invention will now be described with reference to the accompanying drawings in which:

FIG. I is a partial sectional view through a steel container/thermoplastic closure intersection in accordance with the present invention;

FIG. II is a partial sectional view through a thermoplastic container/thermoplastic closure intersection in accordance with the present invention before initial sealing of the closure to the container; and FIG. III is a partial sectional view of the thermoplastic container/thermoplastic closure of FIG. II after initial sealing of the container.

With reference to FIG. I there is disclosed, in section, the upper portion of a steel dangerous goods bucket 1; the extreme upper extremity of the bucket being rolled so as to form an outwardly directed protrusion 2 of substantially constant radius. The closure of FIG. I comprises a disk portion 3 extending via radiused portion 4 into skirt portion 5. In this example internal skirt 6 additionally assists to locate the closure with respect to the container.

The skirt portion 5 is comprised of a relatively thick walled upper section 17 extending into radiused portion 4 with a relatively thin walled stress-relieving annular portion 7 therebeneath lying adjacent outwardly directed protrusion 2 on the container. The thin walled annular stress relieving portion 7 supports relatively thick walled annular ring 8 which it will be noted lies radially inwardly with respect to both thin walled stress-relieving portion 7 and outwardly directed protrusion 2 on the container. A deformable O-ring or "flowed in" gasket 9 lies within the closure adjacent radiused section 4 and is adapted to form a seal between the closure and container once the closure is urged onto the container. Thickened inwardly directed annular ring portion 8 snaps over outwardly directed protrusion 2 and lies therebeneath.

Any tendency for thickened annular inwardly directed portion 8 to relax and creep radially outwardly and upwardly with respect to outwardly directed protrusion 2 thereby weakening the seal effected at O-ring 9 is resisted by relaxation of the thermoplastic material comprising relatively thin walled stress-relieving portion 7. This enhancement of the seal at 9 is due to the fact that annular portion 7 is at least fifty percent thinner than thick walled annular inwardly directed protrusion 8 and is consequently considerably weaker and subject to earlier creep.

It is important however that the walls of annular thin walled portion 7 are not so thin as to cause this part of the skirt to tear or fracture in the event that the container/closure system is subjected to an impact.

Turning now to the embodiment of FIGS. II and III it may be observed that the container is fabricated from thermoplastic material and utilises four externally directed protrusions 10, 11, 12 and 13 in order to enhance its hoop strength. A seal is effected between the closure and container in FIG. II by interaction of the upper extremity 14 of the container and flowed in gasket 15 in the closure much as was the case with respect to the embodiment of FIG. I. The embodiments of FIGS. II and III also form seals at 10, 11, 12 and 13. Annular thin walled stress-relieving portion 7 of the skirt is provided on the skirt wall immediately above annular ring 16. Ring 16 carries an inwardly directed annular protrusion 17 adapted to form an undercut with externally directed protrusion 18 (see FIG. III). It will therefore be appreciated that the embodiments of FIGS. II and III involve multiple seals one adjacent thin walled stress-relieving portion 7 the others thereabove.

Impact testing has revealed that the provision of the thin walled stress-relieving portion 7 above annular inwardly directed protrusion 16 thereby effecting a secondary and mechanical seal apart from that occurring at flowed in gasket 15 has been found to greatly enhance the integrity of a dangerous goods bucket under impact conditions. If for example a container is held upside down and then dropped the seal at floating gasket 15 is subjected to substantial shock due to both contact with the ground and a secondary shock wave from the contents of the container. This shock may cause doming (not shown) of the main horizontal disk of the closure and attendant radially outward movement of the upper portion 19 of the skirt 5 of the closure. It will be observed from FIGS. II and III that this embodiment further includes secondary annular weakened portion 20 in the skirt wall in order that any radially outward movement of the upper portion 19 of the skirt due to an impact may have minimal affect on the lower portion 21 of the skirt 5 and hence minimal interruption to the seal occurring between protrusion 17 and protrusion 18.

It will be noted from FIGS. II and III that annular thin walled stress relieving portion 7 of the skirt relaxes or creeps after initial sealing of the closure (see FIG. III) so as to stretch about externally directed annular protrusion 18 on the container and to allow ring 16 to move radially inwardly beneath protrusion 18. Not only does ring 16 move radially inwardly but it changes its vertical orientation having regard to the fact that the lower extremity 22 of the ring moves radially inwardly with respect to the position of the upper extremity of ring 18 adjacent protrusion 17. This rotation of the ring about its upper extremity when viewed in section as in FIGS. II and III serves to reduce the angle of the undercut formed by inwardly directed protrusion 17 and hence enhance the seal formed between the protrusion 17 and the protrusion 18. Whereas typically inwardly directed protrusions from snap-on closures involve undercuts with angles of ten degrees to fifteen degrees to the horizontal closures in accordance with the present invention may utilise undercuts of greater than fifteen degrees as the abovementioned rotation of the ring serves after sealing to reduce the angle of the undercut as moulded in the unstressed position thereby enhancing the seal between protrusions 17 and 18.

It is important that the hoop-strength of the container/bucket exceeds the creep resistance of annular stress relieving portion 7 on the closure skirt as otherwise the closure skirt may tend to deform the container inwardly rather than effecting an adequate seal. For this reason if the container and closure are fabricated from the same or similar material it is desirable that the annular stress-relieving weakened portion 7 be between thirty and fifty percent of the thickness of the wall of the container and of the skirt of the closure.

Containers in accordance with the present invention are commonly formed from polyolefin plastics such as polypropylene, high density polyethylene (HDPE) or linear low density polyethylene (LLDPE). These plastics have been found to be particularly suitable for either containers or closures.

The closures depicted at FIGS. II and III hereof can additionally incorporate a tamper evident feature whereby an additional weakened annular portion 20 is provided in the closure wall between the primary and secondary seals. This feature is by no means essential to the present invention although duplicates tamper evident features common in respect of thermoplastic closures generally. It is of course important that the weakened portion 20 is adequate to withstand impacts without rupture whilst being capable of tearing under the influence of radially outwardly directed forces imparted when a consumer starts to tear the lower skirt portion away from the upper portion of the closure.

The claims defining the invention are as follows:

1. A thermoplastic closure for an open headed container adapted to effect an impact resistant seal with such a container, the closure being comprised of a circular disk portion and a peripheral skirt portion; the skirt portion including an annular ring adjacent its lower extremity having a radially inwardly directed undercut adapted to lie beneath and radially inwardly with respect to an outwardly directed annular protrusion on a complimentary container; a substantially vertically oriented weakened stress reliving annular portion on the skirt lying immediately above said annular ring; the annular weakened portion having a wall thickness at least twenty percent less than that of the annular ring of the skirt although of adequate thickness to resist premature rupture in the event that the closure/container unit is subject to an impact; seal means between the closure and the container above the annular ring.

2. A closure in accordance with claim 1 hereof wherein the annular weakened portion of the closure is sized with respect to a complementary container such that the interference at any given arc of the ring/protrusion interface about the circumference of the closure is between eighty percent and three hundred percent of the wall thickness of the annular weakened portion whilst the closure is in the sealed position.

3. A closure in accordance with claim 1 hereof wherein the annular weakened portion of the closure is sized with respect to a complementary container such that the interference at any given arc of the ring/protrusion interface about the circumference of the closure is between one hundred percent and two hundred percent of the wall thickness of the annular weakened portion whilst the closure is in the sealed position.

4. A closure in accordance with claim 1 wherein the wall thickness of the annular weakened portion is less than thirty-five percent of the wall thickness of the closure skirt immediately thereabove and less than thirty percent of the average thickness of the annular ring portion therebeneath.

5. A closure in accordance with claim 1 wherein there is provided a secondary weakened portion of the skirt above the annular weakened portion adapted to accommodate a bending moment in the skirt occasioned by impacts which may cause the upper portion of the skirt to expand radially outwardly; the absorption of such bending moment in the skirt being adapted to prevent impact induced radially outward movements of the skirt adjacent the primary annular weakened portion.

6. A thermoplastic closure for an open headed container adapted to effect an impact resistant seal with such a container; the closure being comprised of a circular disk portion and a peripheral skirt portion; the skirt portion including an annular ring adjacent its lower extremity having a radially inwardly directed undercut adapted to lie beneath and radially inwardly with respect to an outwardly directed annular protrusion on the complimentary container; a substantially vertically oriented weakened stress relieving annular portion on the skirt lying immediately above said annular ring; the annular weakened portion having a wall thickness sized to ensure that stress relief and attendant creep in the thermoplastic material of the closure after affixation of the closure to the container occurs substantially at the annular weakened portion thereby allowing the lower portions of the annular ring to move radially inwardly; the wall thickness of the annular weakened portion at all times being of adequate thickness to resist premature rupture in the event that the closure/container unit is subject to an impact; seal means between the closure and the container above the annular ring.

7. A closure in accordance with claim 6 hereof wherein the angle of the undercut with respect to the horizontal plane is greater than eighteen degrees.

8. A closure in accordance with claim 6 being moulded from a polyolefin.

9. A closure in accordance with claim 6 being moulded from polypropylene or high density polyethylene.

10. A closure and open headed container sealing system utilizing a closure in accordance with claim 6 hereof wherein the profiles of the annular protrusion from the container and the annular ring portion on the closure permit radially inward movement of the base of the annular ring of the closure with respect to the top of the annular ring adjacent the annular weakened portion thereby increasing the effectiveness of the seal formed at the undercut.

11. A thermoplastic closure for an open headed container adapted to effect an impact resistant seal with such a container; the closure being comprised of a circular disk portion and a peripheral skirt portion; the skirt portion including an annular ring adjacent its lower extremity adapted to lie beneath and radially inwardly with respect to an outwardly directed annular protrusion on a complimentary container; a substantially vertically oriented weakened stress relieving annular portion on the skirt lying immediately above said annular ring; the annular weakened portion having a wall thickness at least twenty percent less than that of the annular ring of the skirt although of adequate thickness to resist premature rupture in the event that the closure/container unit is subject to an impact; seal means between the closure and the container above the annular ring.

* * * * *